United States Patent [19]

Wilson

[11] 4,046,171

[45] Sept. 6, 1977

[54] HAND LOOM

[76] Inventor: Kathleen V. Wilson, 3039 Calusa St., Coconut Grove, Fla. 33133

[21] Appl. No.: 701,346

[22] Filed: June 30, 1976

[51] Int. Cl.[2] ..... D03D 29/00

[52] U.S. Cl. ..... 139/29; 139/34; 28/151

[58] Field of Search ..... 139/29–34; 28/15; 66/4

[56] References Cited

U.S. PATENT DOCUMENTS

| | | | |
|---|---|---|---|
| 2,150,187 | 3/1939 | Raba et al. | 139/33 |
| 2,244,085 | 6/1941 | Schneidewendt | 28/15 |
| 2,318,877 | 5/1943 | Meyer et al. | 28/15 UX |
| 3,804,127 | 4/1974 | Rose | 139/34 |
| 3,867,965 | 2/1975 | Hanson | 139/33 |
| 3,996,969 | 12/1976 | McCullough et al. | 139/29 |

FOREIGN PATENT DOCUMENTS

| | | | |
|---|---|---|---|
| 1,417,247 | 10/1965 | France | 139/33 |
| 1,376,962 | 12/1974 | United Kingdom | 139/29 |

*Primary Examiner*—James Kee Chi

[57] ABSTRACT

A hand loom including spaced support posts defining a normal weaving plane, a pair of spaced stationary beams spanning the posts and a pair of spaced movable dowels spanning the posts for adjusting the overall length of a weaving which may be made on the hand loom.

8 Claims, 6 Drawing Figures

HAND LOOM

BACKGROUND OF THE INVENTION

In the past there have been numerous types of hand-looms. Representative recent patents issued in the art are U.S. Pat. Nos. 3,867,965 and 3,885,597. Generally, looms require a frame whose members define a weaving plane and dowels over which the warp strands are arranged to be manipulated by a heddle to cause a shed through which a shuttle is passed in a conventional manner. Generally speaking, the overall height of the frame between the frame sides determines the running length of a weaving which can be made on the loom. To increase this length, some looms include a mechanism for rolling the portion of a weaving which has been completed so that the unfinished portion is in a convenient location for the manipulation of the heddle and shuttle in the weaving process.

Recently, in what is known as the fiber arts, contemporary fiber artists utilize various types of very colorful strand material for such weavings; and they often use strands which are relatively thick. Weavings of such fiber materials are highly decorative and colorful but difficult to roll because of bulkiness. This invention is of a relatively small and compact loom on which relatively long weavings can be made by fiber artists with relatively thick strands, but which does not require a roller mechanism.

Additional prior art patents illustrating hand-looms are U.S. Pat. No. 2,582,008; U.S. Pat. No. 2,696,838; and U.S. Pat. No. 3,347,281. The present invention provides, in contrast to the prior art, a loom frame which includes members which are interconnected in such a fashion that they may be extended or compacted, so that, while extended, a long weaving may be made and, when compacted, the loom may be conveniently stored, for example, in the trunk of an automobile. This is significant because as is perhaps well known, the weaving art is one which requires that a beginner take lessons. With this loom the student may visit an artist or teacher for a lesson about weaving basics carrying the loom, for example, in the trunk of an automobile. For the lesson it is removed from the trunk and extended to full size for use in a lesson. The structure permits the weaving to be carried at all times on the loom without the necessity of removing it as will be apparent hereinafter.

OBJECTS OF THE INVENTION

Generally, it is an object of this invention to provide an improved hand-loom which includes a collapsible frame which may be readily transported or stored in a compact space and erected and utilized for making a weaving; and, thereafter, it may be compacted so as to be of a size, while still assembled, which will fit in the trunk of an automobile or other relatively small area for convenient storage while the weaving remains connected to the loom until it is completed.

It is another object of this invention to provide a compact hand-loom which may be utilized for making relatively long weavings; and which may be also utilized as a warping board prior to weaving and, further, which comprises an assembly which may be easily disassembled and stored in a very small space.

It is, also, an object of this invention to provide structure comprised of elements which are adapted for ready assembly into a hand-loom and which elements are composed of parts of predetermined size and shape for inexpensive reproduction, as will be apparent hereinafter.

It is a further object of this invention to provide a hand-loom which includes adjustment means whereby the tension on the warp strands may be adjusted while a weaving is being made for making a tight weaving.

It is, generally, an object of this invention to provide a device as described hereinafter which is simple and inexpensive to manufacture and which is composed of elements which are adapted to make a frame which includes side posts composed of overlapped upper and lower segments which are spanned at their respective upper and lower ends by dowels and which posts include stand pieces, with the stand pieces, the side post segments and the dowels, respectively being of common size and shape for inexpensive manufacture of the same. It includes means for assembling the elements together in a hand-loom which may be adjusted in use to tighten the warp strands during the weaving process, and which may be compacted for storage or travel without removal of the weaving from it, or which may be completely disassembled and stored in a small compact box.

In accordance with these and other objects which will become apparent hereinafter, the instant invention will now be described with reference to the accompanying drawings in which:

DESCRIPTION OF PREFERRED EMBODIMENT

Figure 4:
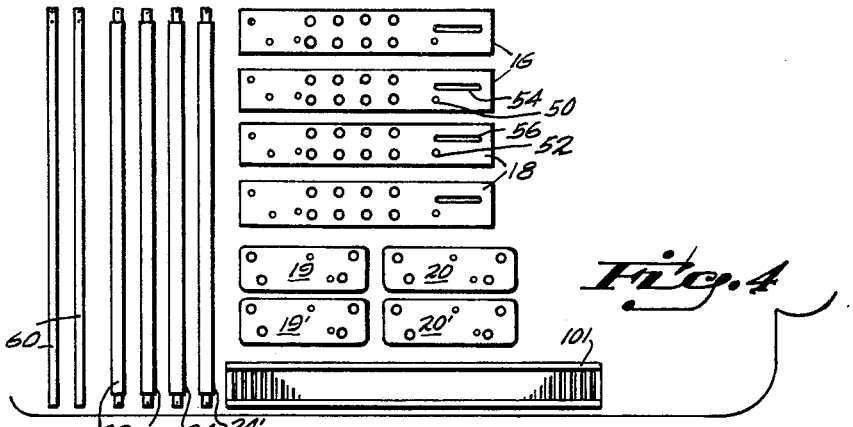
FIG. 4 is an illustration of the parts of the instant loom.

There is shown in the drawings a loom which is generally designated by the numeral 12. It is of the type known in the art as a hand-loom. It is a wall-type hand-loom; that is, one which is adapted to lean against the wall if one wishes.

It consists of a frame 14 which is composed of vertical side posts 16 and 18. At their respective upper and lower ends, each post is provided with a top stand 19 and 19' and a bottom stand 20 and 20'. In the preferred embodiment the bottom stands 20 and 20' extend a common distance in perpendicular relation of the plane defined by the adjacent frame edges; and the top stands 19 and 19' similarly extend in an opposite direction. In the preferred embodiment the upper and lower ends 34 and 34' and 36 and 36' of each of the side posts are provided with a pattern of holes 37 adapted to register with a corresponding pattern of holes 38 in the spanned members which accommodate through headed bolts which are threaded at the extending ends to accommodate wing nuts, such as 40, 42, 44, and 46 for tightening the same together and securing them to the posts. What are denominated as stationary spanning members or dowels 22 and 22' are provided to interconnect the upper stands together and similarly dowels 24 and 24' span the lower stands. Preferably, the ends of these stationary dowels extend through holes in the stands and each are provided with a lateral through hole in the projecting end zone to accept a fastener such as 26, 28, 30 and 32. In the preferred embodiment, the fasteners to connect the stationary dowels or structural spanning members to the stands may comprise holes diammetrically through the ends of the stationary dowels which are sized to receive the shank of a headed peg, which may be in the form of a golf tee, for example see 26 and 28.

Figure 3:
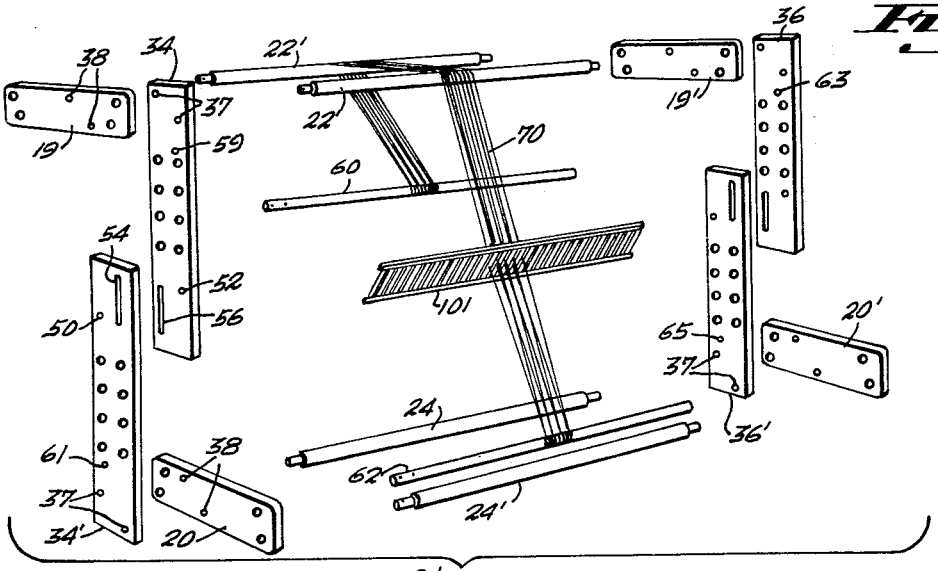
FIG. 3 is an exploded view illustrating the arrangement of the parts of the loom shown in FIGS. 1 and 2.

In the preferred embodiment, each of the side posts is extendible to vary its overall length. As shown, each side post comprises a top segment and a bottom segment with their adjacent ends being in overlapped relation as indicated in FIG. 3 of the drawings. Adjustment means or an adjustment mechanism is provided for raising and lowering the upper post ends or stationary dowels relative to the lower ones by sliding movement of the overlapped ends of the segments of the side posts over one another. The overlapped ends of each segment of each side post is provided with a pin hole, such as 50 and 52, and a vertically extending slot 54 and 56 with each pin hole confronting a slot. A pin in the form of a headed bolt, such as 57 and 57', is passed through each hole and the adjacent confronting slot and it is provided with a wing nut 58 and 58' on the threaded end so that the same may be loosened for sliding extension or contraction of the overall height of the loom frame. This is for the purpose of tightening the work as will be explained more fully hereinafter.

In the extending portion of each of the segments of each of the side posts a plurality of holes are provided in a predetermined pattern which corresponds to that of the opposite segment. These holes accommodate receipt of the ends of a pair of appropriate length movable dowels, elongate cylindrical members, 60 and 62, which are sized to span the side posts with their ends received in a pair of confronting holes, the ends being of a diameter for sliding movement in and out of the holes and rotatable movement in the holes. The two movable dowels are utilized in the operation to be described hereinafter. As is apparent from the drawings, the arrangement of the pattern of holes is such that the longitudinal length of a weaving made on the loom may be adjusted between a maximum and a minimum. In other words, the relative location of the movable dowels, to which the ends of a weaving are securing during use of the loom, may be spaced from one another so that there is a "running distance" which may be selected in a range by the location of the movable dowels, i.e., depending upon which pair of opposing holes the ends of the movable dowels are inserted into.

A rigid heddle, as is customary, is utilized in the operation; the heddle includes a pair of longitudinally extending side rails of common length and parallel relation which are spanned by a plurality of equispaced members. Each member has a central hole through it and defines parallel slots between the adjacent members.

In operation, a person weaving on the loom secures the ends of a plurality of warp strands 70 to one of the movable dowels 62, initially located in spanning relation of the outwardly extending portions of the stands. The other ends of the warp strands are tied to the other movable dowel with the warp strands being in parallel relation. The other dowel is suitably located in a pair of confronting holes which determine the overall length of the weaving to be produced. The running length is the distance between the movable dowel; and it is determined by the distance between the dowels. As is customary, each of the warp strands is passed through a hole or slot of the rigid heddle 101. In operation, when the heddle is manipulated by pushing into the normal plane of the warp strands, a shed or tunnel is formed, see FIG. 3, by those strands which are captivated in the holes of the heddle and those which are free to move in the slots or space between the adjacent members of the heddle until they engage the rail of the heddle. A shuttle is cyclically passed through the shed which is formed, first on one side of the normal plane of the warp strands and then the shed which is formed on the other side of that plane with the warp strands being moved by operation and manipulation of the heddle in a customary push-pull motion.

Certain aspects of the invention shown in the drawings will now be referred to. All four of the post segments are of a common shape, size and with a common pattern of holes through them. The same is true with respect to the four stands. This is also true with respect to the stationary dowels; and it is true with respect to the movable dowels. These aspects of the preferred embodiment provide for ease of manufacture and result in a relatively inexpensive loom. Further, the elements may be assembled together readily and with ease and, when disassembled, may be readily packaged in a compact unit for shipment or storage.

Figure 2:
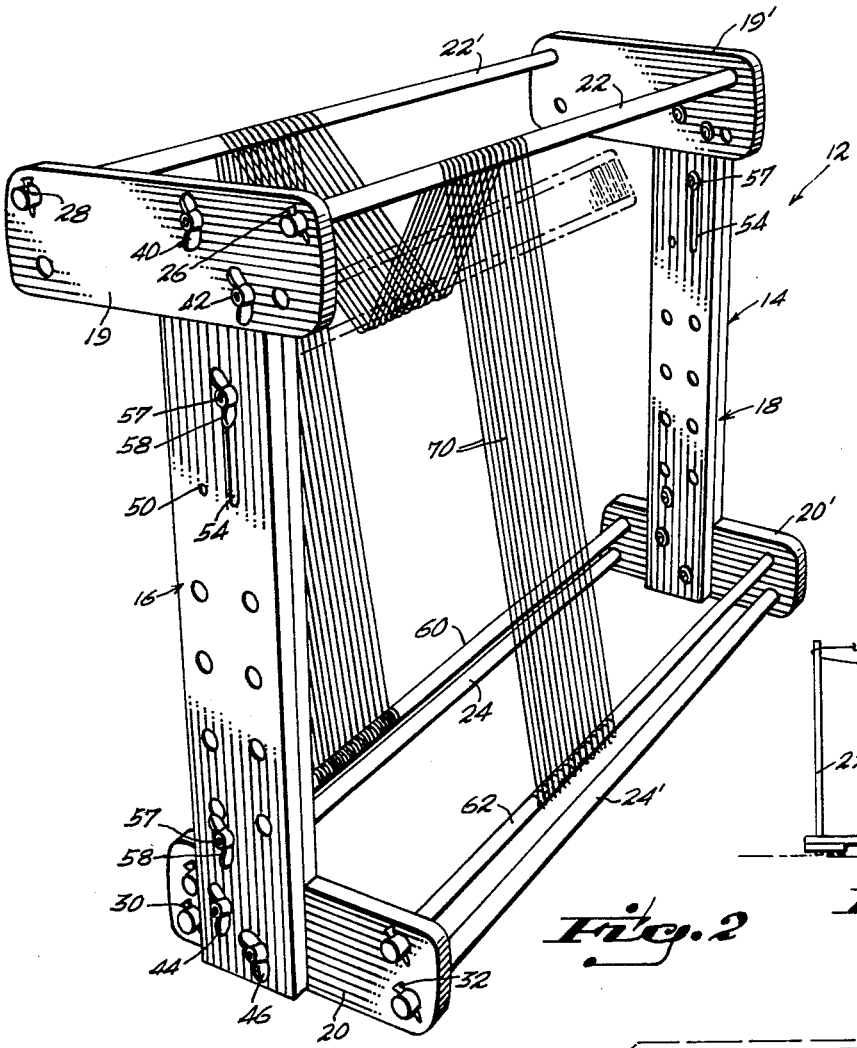
FIG. 2 is a view of the loom according to the instant invention and in a compacted condition.
Figure 5:
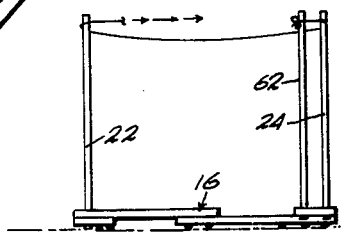
FIG. 5 is a partial view illustrating the use of portions of the loom as a warping board.

Additionally, when in use, that is, while a weaving remains in an unfinished state on the loom, the loom may, nevertheless, be conveniently moved from place to place. To do so the user need only loosen the wing nuts and bolts joining the side post segments together, remove them, and slide the segments of the side posts into completely overlapped relation with their respective ends abutting the adjacent stands, as shown in FIG. 2. The wing nuts may then be secured back again on the bolts through the locking holes 59, 61, 63, 65 which are provided. In this manner, a compact unit is provided which may be sized to fit in the trunk of an automobile. It is particularly adapted, therefore, so that a person may take lessons from a teacher; and, then, although the weaving has not been completed, conveniently store the weaving which is in process in the trunk of a car, take it home and do work on it again, repeating the process until the weaving is completed.

Further it will be seen that, when the wing nuts 58 and 58' are loosened, the pin, hole and slot connections of the overlapped ends of the assembled loom side post segments adapt the loom to a range of movement of adjustment of the running length, because the stationary dowels may be moved vertically with respect to one another so that the warp strands may be tightened. This is preferred for a good weaving operation; and it is suggested because the warp strands may become loosened in use by stretching and cause the weaving to be less than precise.

Figure 1:
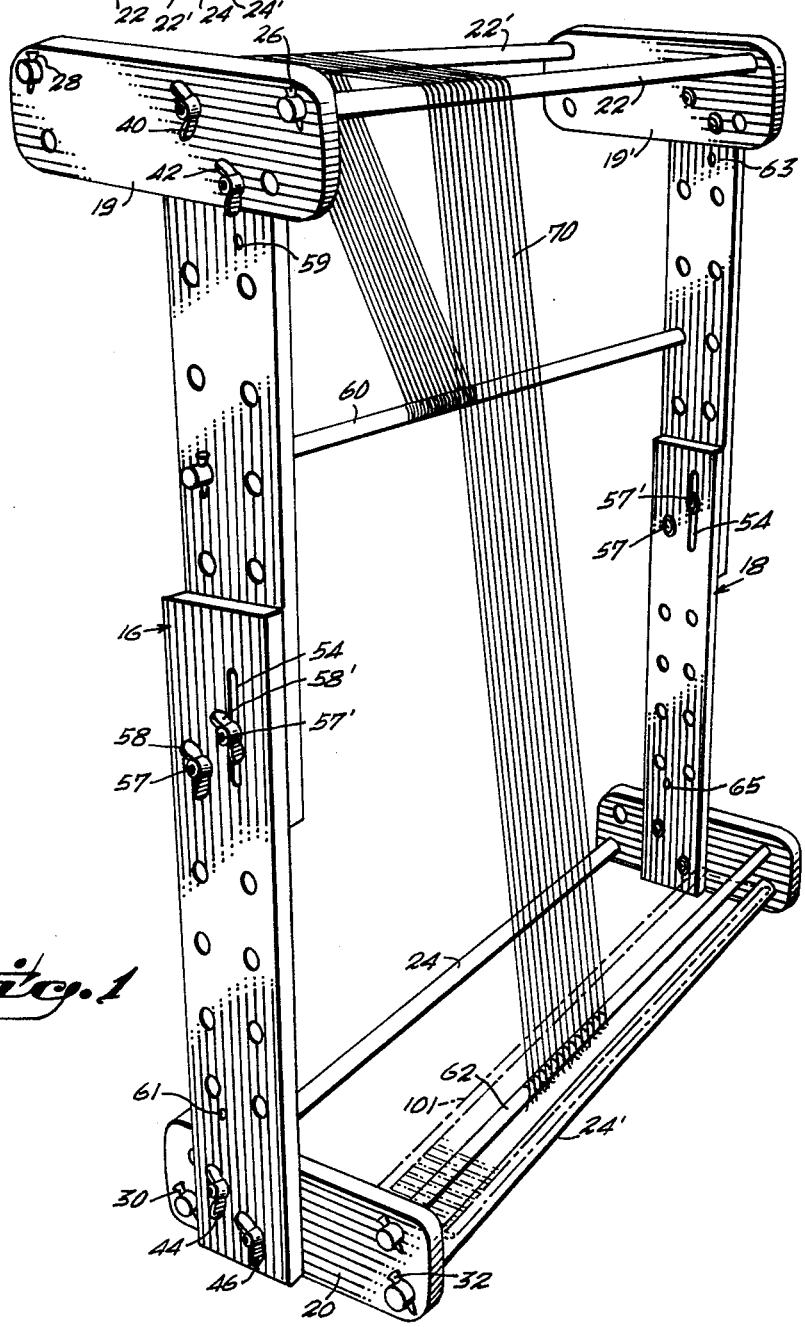
FIG. 1 is a perspective view of the loom of the instant invention.

It will be apparent that the location of the movable dowels determines the overall or running length of the weaving being produced, which may be quite long, as shown in FIG. 1, relative to the overall height of the frame. The length can be selected from a relatively wide range by reason of the pattern of holes which permit positioning of movable dowels on the ends of a pattern of warp strands arranged about the stationary dowels.

In weaving a work of substantial length, it is necessary to advance the weaving in process. In the past, hand-looms have utilized various types of rolling mechanisms, sometimes referred to as cloth beams, to roll the finished weaving so that the working zone would be conveniently located for relative comfort of the user, see for example U.S. Pat. No. 3,867,965 and U.S. Pat. No. 2,696,838, FIG. 10. The instant structure does not require such mechanisms because the movable dowels are adjustable with respect to the stationary dowels through a wide range of adjustment making it possible to relax the tension on the warp strands by loosening the wing nuts 57 and 58, so that the movable warp dowels may be adjustably and rotatably advanced about the stationary dowels of the frame carrying with it the weaving being made. Also, the weaving when partially completed may be completely removed from the loom frame and rolled about the movable dowels whereupon the structure of the frame itself may be completely dismantled and stored in the container shown in FIG. 6 together with the roller weaving.

There is one additional use of the invention which should be referred to. Most weavers when measuring a warp thread find it appropriate to use what is known as a warping board. For this purpose in the art there are many types of devices which are known as warping trees or warping boards. The instant invention, prior to assembly of the side posts of one side, and when tipped on the side so that the side post really acts as a floor or stand and with the stationary dowels extending upwardly, there is defined a pattern of upstanding members about which the warp strands may be arranged in a pattern and the movable dowels can also be utilized to cause a wrapping about the members to be of a common length, so that they can all be cut at one time to form warp stands of a common length.

Figure 6:
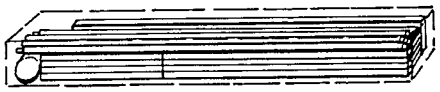
FIG. 6 is an arrangement of parts in a shipping and storage box.

In the preferred embodiment, the said post segments are each 22 inches long, the stands are 11 inches long, and both stands are 4 inches wide. The stationary and warping dowels are about 36 inches long and about ¾ to 1 inch in diameter. The heddle preferred is 32½ inches in overall length. With reference to FIG. 6, it is seen that the relative size and shape of the elements permit compact packaging for shipment and storage in a container having dimensions of about 36 inches by 5½ inches and by 5 inches.

What is claimed is:

1. A hand-loom comprising (A) spaced posts defining a main normal weaving plane, each side post having an upper end and a lower end and said lower ends each including a portion extending outwardly in perpendicular relation to said plane a common distance and direction, (B) spaced stationary beams spanning the upper and lower ends of the posts and defining a loom frame, (C) means removably connecting the beams and posts together, (D) each of said posts having a surface with a pattern of recesses of common cross sectional area, said surfaces and the recesses of said patterns being in confronting relation with one another, and each of said posts includes a first and a second segment, each of said segment having an inner end and means connecting the inner ends in overlapped relation and said means removably connecting including means for adjusting the overall length of each of said posts by bypassing movement of the inner ends of each over one another, and (E) a pair of spaced movable dowels spanning the posts, each of said dowels having opposite end zones and said end zones being sized for receipt in said recesses.

2. The device as set forth in claim 1 wherein the means to connect comprises a slot and extending longitudinally in the inner end of each segment and a hole adjacent each slot and a pin means through each hole and slot to permit a range of adjustment of the overall post length and said pin means including tightening means.

3. The hand-loom as set forth in claim 1 wherein said upper ends each include a portion extending perpendicularly of the normal weaving plane a common distance and in a direction opposite to that of said portions on said lower ends.

4. The device as set forth in claim 3 wherein said portions comprise separate stand means and means to affix one of said portions to each end of each said side posts.

5. The device as set forth in claim 4 wherein said spaced stationary means span said stand means.

6. The device as set forth in claim 3 wherein said portions comprise separate stand means and means to affix one of said portions to each end of each said side posts.

7. The device as set forth in claim 6 wherein said spaced stationary means span said stand means.

8. The device as set forth in claim 6 wherein all of said segments are each of similar size and shape and all of said stands are of similar size and shape.

* * * * *